US009284154B2

(12) United States Patent
Seidler et al.

(10) Patent No.: US 9,284,154 B2
(45) Date of Patent: Mar. 15, 2016

(54) METHOD OF TRANSFERRING PROCESSING PARAMETERS AND METHOD OF PROCESSING SHEET-SHAPED COPIES OF A PRINT MEDIUM

(75) Inventors: Malte Seidler, Heidelberg (DE); Albert Maul, Heidelberg (DE); Thomas Schmid, Rauenberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 2705 days.

(21) Appl. No.: 11/780,195

(22) Filed: Jul. 19, 2007

(65) Prior Publication Data

US 2008/0017060 A1 Jan. 24, 2008

(30) Foreign Application Priority Data

Jul. 19, 2006 (DE) ..... 10 2006 033 365

(51) Int. Cl.

| | |
|---|---|
| ***G06F 15/00*** | (2006.01) |
| ***H04N 1/40*** | (2006.01) |
| ***G06K 15/00*** | (2006.01) |
| ***B65H 43/04*** | (2006.01) |

(52) U.S. Cl.

CPC ..... *B65H 43/04* (2013.01); *B65H 2511/40* (2013.01); *B65H 2553/00* (2013.01)

(58) Field of Classification Search

CPC ..... B41J 3/50
USPC ..... 358/1.14, 1.15, 1.16, 3.28, 1.9, 504; 382/112, 141, 149; 412/14
See application file for complete search history.

(56) References Cited

U.S. PATENT DOCUMENTS

| | | | | |
|---|---|---|---|---|
| 6,684,787 | B1 | 2/2004 | Sauer | |
| 7,184,680 | B2 | 2/2007 | Sawada | |
| 7,573,387 | B2 | 8/2009 | Shimazu et al. | |
| 2006/0038844 | A1 | 2/2006 | Kiwada et al. | |
| 2006/0228153 | A1 * | 10/2006 | Marowski et al. | 400/679 |
| 2007/0223014 | A1 | 9/2007 | Lenkl | |

FOREIGN PATENT DOCUMENTS

| | | | |
|---|---|---|---|
| CN | 1370098 | A | 9/2002 |
| DE | 1 212 563 | | 3/1966 |
| DE | 40 09 415 | A1 | 11/1990 |
| DE | 102 10 765 | A1 | 10/2003 |
| DE | 103 29 833 | A1 | 2/2005 |
| DE | 10 2005 009 301 | A | 9/2006 |
| EP | 1 493 701 | A1 | 1/2005 |

(Continued)

OTHER PUBLICATIONS

English translation of Chinese Office Action dated Jan. 8, 2010.

*Primary Examiner* — Thomas Lett
(74) *Attorney, Agent, or Firm* — Laurence A. Greenberg; Werner H. Stemer; Ralph E. Locher

(57) ABSTRACT

A method of transferring processing parameters of a print medium includes the steps of reading values of processing parameters from a portable data carrier into a control unit of the processing machine or from a control unit of the processing machine into a portable data carrier and causing the portable data carrier, together with the pile of sheet-shaped copies of the print medium, to interact with the processing machine in such a way that an automated data transfer into the control unit or from the control unit of the processing machine can take place.

22 Claims, 1 Drawing Sheet

(56) References Cited

FOREIGN PATENT DOCUMENTS

| | | | |
|---|---|---|---|
| EP | 1 760 638 | A1 | 3/2007 |
| JP | 2005255283 | A | 9/2005 |
| JP | 2006056014 | A | 3/2006 |
| JP | 2006082386 | A | 3/2006 |
| WO | 2005102719 | A1 | 11/2005 |
| WO | 2005124666 | A1 | 12/2005 |
| WO | 2006/056599 | A1 | 6/2006 |

* cited by examiner

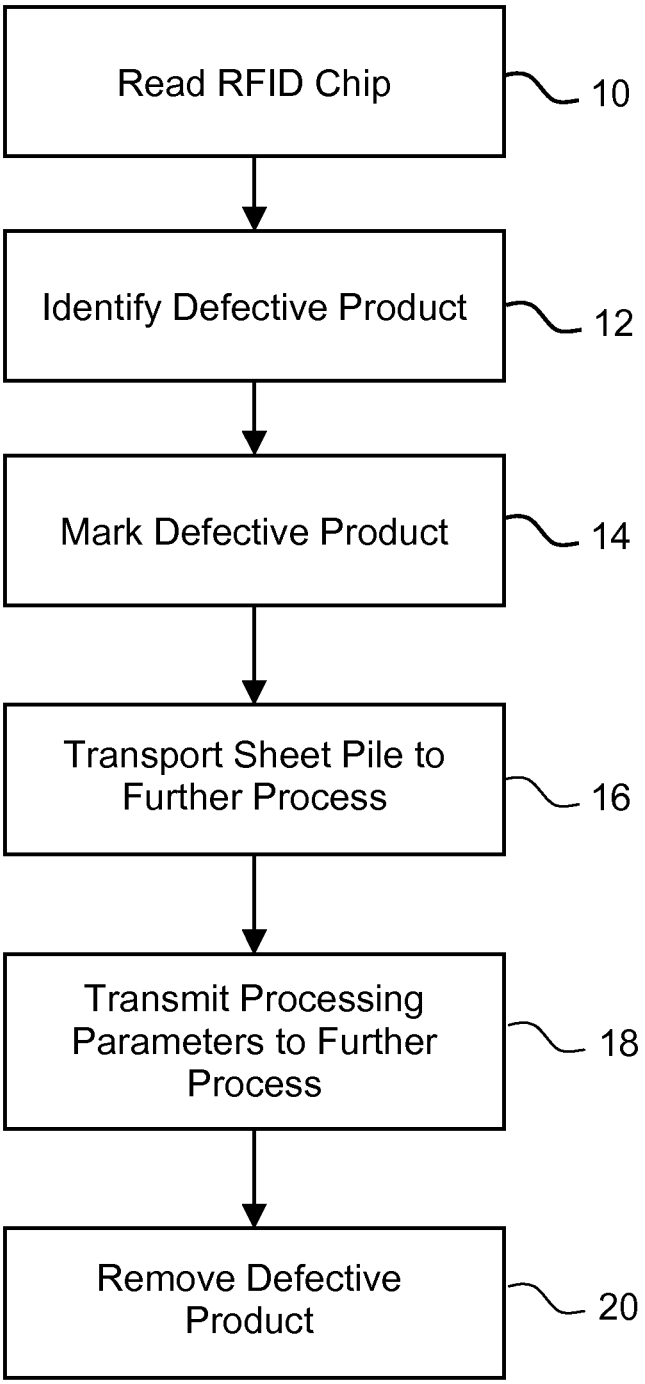
Read RFID Chip
10
Identify Defective Product
12
Mark Defective Product
14
Transport Sheet Pile to Further Process
16
Transmit Processing Parameters to Further Process
18
Remove Defective Product
20

METHOD OF TRANSFERRING PROCESSING PARAMETERS AND METHOD OF PROCESSING SHEET-SHAPED COPIES OF A PRINT MEDIUM

CROSS-REFERENCE TO RELATED APPLICATION

This application claims the priority, under 35 U.S.C. § 119, of German patent application DE 10 2006 033 365.9, filed Jul. 19, 2006; the prior application is herewith incorporated by reference in its entirety.

BACKGROUND OF THE INVENTION

Field of the Invention

The invention relates to a method of transferring processing parameters of a print medium comprising the steps of reading values of processing parameters from a portable data carrier into a control unit of the processing machine or from a control unit of the processing machine to a portable data carrier. The invention further relates to a method of processing sheet-shaped copies of a print medium wherein sheet-shaped copies of a print medium are printed in a printing press, the printed sheet-shaped copies of the print medium are deposited on a pile, and the stacked sheet-shaped copies are processed in a further print processing machine.

The control units of individual processing machines, in particular prepress devices, printing presses, and further processing machines, as part of a processing chain for producing copies of a print medium are usually connected to each other via a data exchange network. As a consequence, appropriate preset values for a processing step, in particular for the print job, can be sent to a particular processing machine. The aim of the CIP4 Organization, which has many members in the graphic industry, is to provide a standard for the requirements of such networking. For this purpose, the Job Definition Format (JDF) has been established, which is specified in detail in a number of specifications issued by the CIP4 Organization, in particular in JDF Specification Version 1.2. As a particular feature of the JDF standard, it is possible to store or process information on defective products that are created during a printing operation.

The treatment of defective products is of particular importance in the production of print media because in high-quality print jobs, it is essential to separate defective products from copies that meet the required quality standard. Defective products are usually marked or separated from a group, e.g. a pile, of copies in a manual process. In particular, the defective products are manually removed from a pile that includes sections marked as waste sections. Such a process requires a considerable amount of manual work and is subject to errors.

German published patent application DE 103 29 833 A1, for example, describes a delivery of a sheet-processing printing press wherein non-defective sheets are deposited on a pile and defective sheets are fed to a sheet receiving device, for example a container. Removing defective products in this way requires corresponding modifications of the construction of the delivery and is therefore rather complicated.

German published patent application DE 40 09 415 A1, for example, describes that sheets that have been identified as defective in a folding machine are clearly marked by an additional wrong fold so that an operator can easily recognize defective products on the delivery table and remove them.

Moreover, German published, prosecuted patent application DE 1 212 563 describes that a web-fed rotary printing press may include a monitoring device for detecting defects on the running web in the printing press so that the defective printed copies can be removed before they reach the folder that is connected to the printing press or at least in the folder.

SUMMARY OF THE INVENTION

It is accordingly an object of the invention to provide a method for transferring processing parameters and for processing sheet-shaped printing materials, which overcomes the above-mentioned disadvantages of the heretofore-known devices and methods of this general type and which further improves the logistics in the production of printed products.

With the foregoing and other objects in view there is provided, in accordance with the invention, a method of transferring processing parameters of a print medium. The novel method comprises at least the following steps:

reading values of processing parameters from a portable data carrier into a control unit of a processing machine or from a control unit of the processing machine to a portable data carrier; and causing the portable data carrier, together with a pile of sheet-shaped copies of the print medium, to interact with the processing machine to enable an automated transfer of data into the control unit or from the control unit of the processing machine.

In other words, the method according to the invention of transferring (or transmitting) processing parameters of a print medium comprises the steps of reading values of processing parameters from a portable data carrier into a control unit of the processing machine or from a control unit of the processing machine to a portable data carrier and causing the portable data carrier, together with a pile of sheet-shaped copies of the printed medium, to interact with the processing machine in such a way that an automated data transfer into or from the control unit of the processing machine can take place.

The print medium may also be referred to as a printing material. The print medium may in particular be paper, board, cardboard or organic polymer foil. The print medium may preferably be flat and thin in particular in a direction perpendicular to the sheet surface as compared to the dimensions of the sheet. The automated data transfer may preferably take place without contact. The portable may directly or indirectly be connected to the pile of sheet-shaped copies or may be received on the pile of sheet-like products. The portable data carrier may be attached to a pile carrier, in particular a pallet. The control unit may include a write and/or read device for the portable data carrier or may be connected to such a device.

The logistics of the print production is advantageously improved because details on the processing of the print mediums, in particular on values of processing parameters that are to be considered or may occur, can be transmitted automatically, in a definite correlation with the printed medium and without any additional work for the operator. No network and/or central processing unit connecting the individual processing machines are required for the transfer of the concrete values of processing parameters. Due to the concrete correlation between the portable data carrier and the pile of sheet-shaped copies, errors of allocation can be avoided even when a number of piles and sets of processing parameter data are present.

In concrete embodiments of the method of transferring processing parameters of a print medium the portable data carrier may comprise a barcode representation or an electronic memory medium. The data carrier is preferably a RFID chip (Radio Frequency Identification Chip), which can communicate electromagnetically in a radio frequency with a write and/or read device. The RFID chip may be active or passive.

In accordance with a particularly advantageous further feature of the invention, the data carrier may be erasable and rewritable, so that it can be used a number of times.

A further aspect in connection with the idea of the invention, both in connection with or independently of the features described above, is a method of transferring processing parameters of a print medium wherein values of processing parameters are read from a data carrier into a control unit of the processing machine or from a control unit of the processing machine to a data carrier. In this method of the invention, the values of processing parameters for a pile of printed sheet-shaped copies of the print medium comprise information on the quantity of defective products present in the pile.

In contrast to known devices for removing defective sheets the invention proposes to mark the defective products electronically by storing information on the occurrence of defective products in the pile. In this manner, the defective products may be removed later in a different processing step rather than immediately after they have been produced, for example in the printing press, specifically directly in the delivery.

The information on the quantity of the defective products may in particular refer to the total number of entire sheets in the pile or to the usability of individual blanks on a sheet with a number of blanks. In other words, if there are printed copies that include multiple blanks, the information that can be transferred by means of the data carrier may be detailed enough for the values of this processing parameter to specify which parts of the defective sheet may be used and which parts may not be used, i.e. which parts are truly defective. Consequently, the number of copies that are not usable may be reduced to the lowest possible number, and parts of copies that are partly usable may be further processed.

In accordance with a preferred embodiment of this method of the invention of transferring processing parameters of a print medium, information on the sequence of defective sheets and non-defective sheets in the pile of printed sheet-shaped copies of the print medium is stored on the data carrier. In addition or alternatively, in the case when multiple blanks are present on a printed sheet-shaped copy, information on the usability of individual blanks on the sheet-shaped copy is stored on the data carrier.

In accordance with a further feature of the methods of the invention of transferring processing parameters of a print medium, the processing parameters may describe properties of the print medium, in particular the thickness/height of the print medium, the format or the weight. These values may be used to check whether the print medium is suitable for the job in question and/or for automatic pre-setting of the processing machine. In addition or alternatively, the processing parameters may comprise job data. These job data may in particular include job number, job volume, information on the customer, deadlines and/or job data indicated in the JDF specification.

The method of the invention of transferring processing parameters of a print medium is carried out for a printing press or a further processing machine of the printing industry, in particular a die-cutter, a folding machine, or a saddle stitcher. In other words, the processing machine may be a printing press or a further processing machine of the printing industry.

The printing press is preferably a planographic printing press operating in accordance with a direct or indirect printing process, in particular an offset printing press. The printing press may preferably be a sheet-fed printing press. The printing press may include a sheet feeder, a number of printing units, for example 4, 6, 8, 10, or 12 printing units, and a delivery.

The scope of the present invention also includes a pile of sheet-shaped copies of a print medium on a pallet comprising a data carrier, in particular an RFID chip, which is suitable for carrying out a method having features or a combinations of features in accordance with the present description.

In accordance with a consistent further development of the invention, a method of processing sheet-shaped copies of a print medium is provided. In accordance with the invention, the method comprises at least the steps of printing the sheet-shaped copies of the print medium in a printing press, depositing the printed sheet-shaped copies of the print medium on a pile, in particular on a pile formed on a pallet, further processing the stacked sheet-shaped copies in a further processing machine, and in the process transferring parameters of the print medium in accordance with a method of transferring processing parameters of a print medium including features or combinations of features in accordance with the present description.

In such developments of the invention, the printing step is preferably carried out in an offset printing press, in particular in a sheet-fed offset printing press, to which the unprinted sheet-shaped copies of the print medium are fed from a pile.

It is evident to a person skilled in the art as addressed by the present description that it is not only a portable data carrier, in particular a RFID chip, of a pile of sheet-shaped copies of the printed product that is caused to interact with the processing machine in such a way that an automated data transfer into the control unit or from the control unit of the processing machine can be carried out. In an analogous way, including features or combinations of features of the present description, it is also possible to equip consumables directly or indirectly (in particular the packaging or containers thereof) with a portable data carrier. Important examples for this type of consumables are printing inks and exposed printing forms. A printing press equipped in accordance with the invention may then check whether the correct printing ink and/or the correct printing forms are being fed.

In addition or alternatively, a preferred feature of such further developments is that the control unit of the printing press stores information on the portable data carrier to indicate which of the sequence of sheet-shaped copies deposited on the pile are defective.

Moreover, such methods of processing sheet-shaped copies of a print medium may include the step of separately processing the defective products in the further processing machine in an automated way.

Other features which are considered as characteristic for the invention are set forth in the appended claims.

Although the invention is illustrated and described herein as embodied in method of transferring processing parameters and of processing sheet-shaped copies of a print medium, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

BRIEF DESCRIPTION OF THE DRAWING

The sole FIGURE illustrates a flow chart of a preferred embodiment of the method according to the invention with various further developments.

DETAILED DESCRIPTION OF THE INVENTION

In the preferred embodiment described herein, an RFID chip is attached to or integrated into a pallet of a pile of paper sheets to be processed in a printing press, in particular an offset printing press. An RFID chip integrated in a pallet of a paper pile may be written on and/or read in a touch-free wireless way. Information about the paper and the job are stored on the RFID chip in a touch-free way. The producer of the paper may be the first to write information about the paper, in particular the properties of the material, onto the RFID chip. Alternatively, the paper may be re-stacked onto specially equipped pallets in the print shop and the associated information about the paper may then be written onto the RFID chip. Re-stacking is a common feature in print shops with special logistics systems, so that this additional feature of the invention does not require any disadvantageous additional work. As an alternative to receiving an integrated RFID chip in the pallet, an RFID chip may be attached to a conventional pallet (that may or may not carry paper) in the form of a sticker or mechanically, for example by stapling. At the feeder of the printing press, this information will be read into the control unit of the printing press, so that the control unit may check whether the paper is suited for the current print job and may preset the printing press.

In the delivery, processed paper sheets are deposited in a pile on a pallet that includes an RFID chip. As mentioned above, a pallet with an integrated RFID chip or a conventional pallet to which an RFID chip has been attached, in particular by an operator, may be used. Data on the properties of the printed paper sheets, in particular which sheets in the deposit pile are defective, are stored in a touch-free manner on the RFID chip. In further processing steps in a further processing machine, in particular in a die-cutter or a folding machine, the defective products may be removed.

Referring now to the sole FIGURE of the drawing in more detail, there is shown a flow chart of a preferred embodiment of the method of the invention with various further developments of a workflow in the production of print media.

The RFID chip of a paper pile, which is received on a pallet, is read out in the feeder of a sheet-fed offset printing press, so that information on the properties of the material of the paper may be read into the control unit of the sheet-fed printing press. The workflow of the preferred embodiment of the method of the invention thus comprises a step 10 of reading in the properties of the printing material. As the reading and writing range of common RFID chips at the moment may be as much as a few meters, the pallet does not have to be aligned with particular precision in the feeder (nor in the delivery). The printing press reads the information about the paper as it is stored on the RFID chip, checks whether the paper is suited for the current job, and starts presetting.

Defective products are created during printing for different reasons. In particular, the operator must adjust the press before acceptable sheets are printed. In other words, all sheets up to a first sheet that meets the requirements (acceptable sheet) are defective products. In addition, defective products are created when the machine is stopped and restarted (start-up waste), when the press speed is changed (for example because the printing units are no longer in register when the speed is changed), and when disruptions of the power supply occur.

In a step 12, the defective products that have been created are identified. There are in particular two ways of establishing which part or parts of the production are defective and which part or parts are not. On the one hand, the operator may input into the control of the press which printed sheets are to be counted as defective and which are not. On the other hand, an automatic inspection of the sheets, in particular an optical evaluation of the printed image, may take place to identify individual sheets or a number of sheets as defective. In other words, the control unit may have an identifying value that may assume at least two states (one for defective products and one for acceptable sheets). The states can be switched, for example by input via a human/machine interface or by an automatic control. It is possible to determine whether individual blanks of a sheet with multiple blanks are unusable while other individual blanks of the same sheet may be usable because they meet the quality requirements in particular by evaluating the entire printed image.

In a step 14, the defective products are electronically marked. In the delivery of the printing press, the information about which sheets or blanks on a sheet with a number of blanks are defective is written onto the electronic storage medium, for example the RFID chip in the pallet of the delivery pile. Advantageously, as a result of the invention, the location of the defective products in the pile does not have to be marked, the defective products do not have to be optically marked themselves, and they do not have to be removed from the pile. Another non-negligible advantage of this embodiment including an RFID chip is that contaminations as they may occur in the delivery of a printing press for example due to powder dust, do not have any negative influence on the functioning of the method because a wireless or touch-free, non-optical way of data exchange between the control unit and electronic medium is used. In this embodiment, additional job data such as the job number and job data indicated in the JDF specification are stored on the RFID chip.

For correct further processing of the pile, the association of the information stored on the RFID chip with the individual sheets in the pile, which are in a certain order, must be maintained. This necessity in particular incurs that no operator may remove sheets from the pile or rearrange sheets in the pile without informing the relevant processing machine in the workflow or correcting the data on the RFID chip in a corresponding way. As a consequence, the device for removing samples in the delivery of the printing press is designed so that the removal of sheets is taken into account when the information is written on the RFID chip. Moreover, the delivery has an input device for the printer to input the number of the removed sheets and other information required for identifying the defective products and/or the order of the sheets in the pile to make this information available to the control unit of the printing press.

In a step 16, the sheet pile including at least some defective sheets and the RFID chip that has been written on are transported together to a further processing device, for example a die-cutter. In this way, both the printed sheets to be processed and the relevant values of processing parameters associated therewith are jointly supplied to the further processing machine in a correlated manner.

In a step 18, values of processing parameters are transferred to the further processing machine by means of the RFID chip so that the defective products are taken into account during further processing. The control unit of the further processing machine, in this case the die-cutter, reads the information stored on the RFID chip so that the further processing machine may be set accordingly and/or may react in an appropriate way to every individual sheet to be processed.

It is to be noted here that if the described further processing operation is only a first further processing operation such as cutting, printing a special or spot color, or varnishing in a special machine, additional defective products may be created. For subsequent further processing operations, the information about these defective products is stored on a RFID chip in an analogous way in addition to the remaining other relevant information. In other words, the method of the invention may be iterated for a number of successive processing operations.

In a step 20, the defective products are removed. According to the invention, the removal of the defective products present in a pile of sheets takes place in a processing step of the printed product in which removal is easy. In the case of a die-cutter, the defective products may be disposed of in the container for the cutting waste. It is even possible to remove individual defective blanks by means of a removal device and to dispose of them in the container while acceptable blanks continue to be processed.

The invention claimed is:

1. A method of transferring processing parameters of a print medium, the method which comprises:

reading values of processing parameters concerning several sheet-shaped copies of the print medium from a portable data carrier into a control unit of a processing machine or from a control unit of the processing machine to a portable data carrier;

causing the portable data carrier, together with a pile of the sheet-shaped copies of the print medium, to interact with the processing machine to enable an automated transfer of data into the control unit or from the control unit of the processing machine.

2. The method according to claim 1, wherein the portable data carrier comprises an electronic memory medium.

3. The method according to claim 1, wherein the portable data carrier is erasable and rewritable.

4. The method according to claim 1, wherein the processing parameters describe properties of the print medium.

5. The method according to claim 1, wherein the processing parameters comprise job data.

6. The method according to claim 1, wherein the portable data carrier is an RFID chip.

7. The method according to claim 1, wherein the processing machine is a printing press or an after-press processing machine of print materials.

8. A method of transferring processing parameters of a print medium, the method which comprises:

acquiring information about a quantity of defective products in a pile of printed sheet-shaped products during processing of a print medium and writing corresponding values of processing parameters; and reading the values of the processing parameters, with the information about the quantity of the defective products in the pile, from a data carrier into a control unit of a processing machine or from the control unit of the processing machine to the data carrier.

9. The method according to claim 8, which comprises storing on the data carrier information about an order of defective sheets and acceptable sheets in the pile of printed sheet-shaped copies of the print medium.

10. The method according to claim 8, which comprises, if a number of blanks are present on a printed sheet-shaped copy, storing on the data carrier information about a usability of individual blanks on the sheet-shaped copy.

11. The method according to claim 8, wherein the processing parameters describe properties of the print medium.

12. The method according to claim 8, wherein the processing parameters comprise job data.

13. The method according to claim 8, wherein the data carrier is an RFID chip.

14. The method according to claim 8, wherein the processing machine is a printing press or an after-press processing machine of print materials.

15. A method of processing sheet-shaped copies of a print medium, the method which comprises:

printing on the sheet-shaped copies of the print medium in a printing press;

depositing the printed sheet-shaped copies of the print medium on a sheet pile;

further processing the stacked sheet-shaped copies in a further processing machine of the printing industry;

transferring parameters of the print medium with a method of transferring processing parameters according to claim 1.

16. The method according to claim 15, which comprises feeding unprinted sheet-shaped copies of the print medium from a pile to a sheet-fed offset printing press, and printing in the sheet-fed offset printing press.

17. The method according to claim 16, which comprises storing, with a control unit of the printing press, information on the portable data carrier about which of the successive sheet-shaped copies that have been deposited on the pile are defective.

18. The method according to claim 17, which comprises automatically processing the defective products separately in the further processing machine.

19. A method of processing sheet-shaped copies of a print medium, the method which comprises:

printing on the sheet-shaped copies of the print medium in a printing press;

depositing the printed sheet-shaped copies of the print medium on a sheet pile;

further processing the stacked sheet-shaped copies in a further processing machine of the printing industry;

transferring parameters of the print medium with a method of transferring processing parameters according to claim 8.

20. The method according to claim 19, which comprises feeding unprinted sheet-shaped copies of the print medium from a pile to a sheet-fed offset printing press, and printing in the sheet-fed offset printing press.

21. The method according to claim 20, which comprises storing, with a control unit of the printing press, information on the portable data carrier about which of the successive sheet-shaped copies that have been deposited on the pile are defective.

22. The method according to claim 21, which comprises automatically processing the defective products separately in the further processing machine.

* * * * *